United States Patent [19]

Piorkowski et al.

[11] Patent Number: 4,676,236

[45] Date of Patent: Jun. 30, 1987

[54] HELMET AIRFLOW SYSTEM

[75] Inventors: Gary J. Piorkowski, Aldenville; William P. Giacomini, Old Forge, both of Pa.

[73] Assignee: Gentex Corporation, Carbondale, Pa.

[21] Appl. No.: 814,283

[22] Filed: Dec. 23, 1985

Related U.S. Application Data

[63] Continuation of Ser. No. 530,483, Sep. 9, 1983, abandoned.

[51] Int. Cl.[4] ..... A62B 7/00

[52] U.S. Cl. ..... 128/201.23; 128/201.25; 128/200.28

[58] Field of Search ..... 128/201.15, 201.22–201.29, 128/205.24, 204.18

[56] References Cited

U.S. PATENT DOCUMENTS

| | | | |
|---|---|---|---|
| 428,611 | 5/1896 | Hurd | 128/201.28 |
| 2,156,852 | 5/1939 | Horak | 128/141 |
| 2,365,779 | 12/1944 | Schwab | 128/141 |
| 2,569,451 | 10/1951 | Browne | 128/201.27 |
| 2,619,085 | 11/1952 | Bradley | 128/207.12 |
| 2,810,386 | 10/1957 | Reed | 128/201.15 |
| 2,835,250 | 5/1958 | Austin | 128/141 |
| 3,076,454 | 2/1963 | Evans et al. | 128/142 |
| 3,362,403 | 1/1968 | Fleming et al. | 128/142 |
| 3,433,222 | 3/1969 | Pinto | 128/201.24 |
| 3,716,053 | 2/1973 | Almovist et al. | 128/201.15 |
| 3,739,774 | 6/1973 | Gregory | 128/201.28 |
| 3,892,234 | 7/1975 | Jones | 128/201.27 |
| 3,911,914 | 10/1975 | Johansson | 128/201.23 |
| 3,995,627 | 12/1976 | O'Neill | 128/201.15 |
| 4,126,131 | 11/1978 | Davis et al. | 128/201.15 |
| 4,250,877 | 2/1981 | Owens et al. | 128/201.23 |
| 4,274,404 | 6/1981 | Molzan et al. | 128/205.24 |
| 4,404,969 | 9/1983 | Cresswell et al. | 128/201.28 |

FOREIGN PATENT DOCUMENTS 2903921 8/1980 Fed. Rep. of Germany .

*Primary Examiner*—Henry J. Recla

*Attorney, Agent, or Firm*—Shenier & O'Connor

[57] ABSTRACT

An airflow system for use with a helmet includes a face piece adapted to enclose the eyes of the wearer to form a first cavity and to enclose the nose and mouth of the wearer to form a second cavity isolated from the first cavity. Filtered air normally flows through an inlet to the first cavity, from which it flows to the second cavity through a conduit and eventually to the ambient region through an exhalation duct leading from the second cavity. The air is supplied under pressure to the first cavity and the exhalation duct provided with check valves at its inlet and outlet to maintain a positive pressure in the first cavity, thereby to prevent the infiltration of noxious gases, over most of the breathing range. A spring-loaded check valve normally admits additional air directly to the second cavity through a second inlet to prevent excessive airflow through the first cavity across the eyes of the wearer. A check valve in the conduit connecting the first and second cavities prevents fogging of the visor due to backflow of exhaled air. Air is also directed from the mask through a check valve to the over-the-head region enclosed by the helmet to cool the wearer's head and to create a positive pressure to prevent the seepage of unfiltered gases into that region.

11 Claims, 3 Drawing Figures

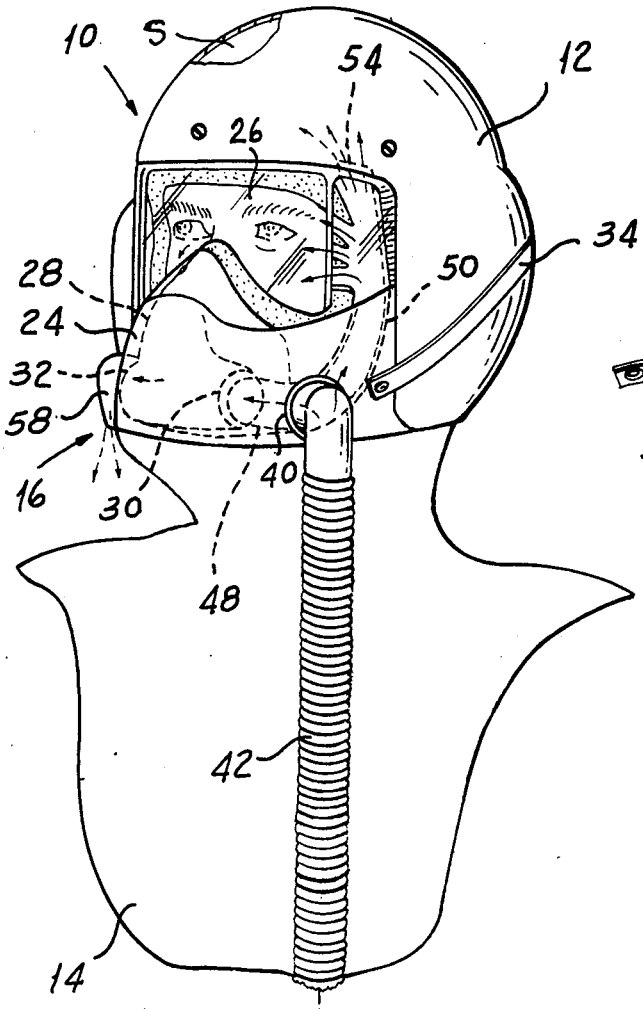
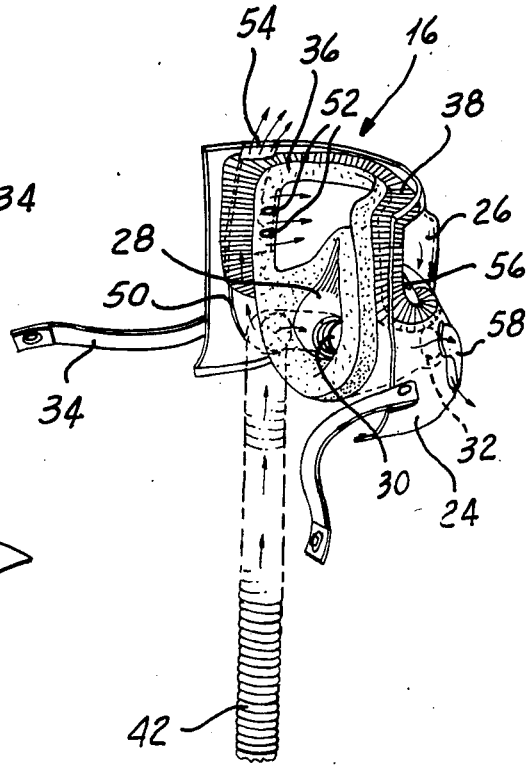
Fig 2
Fig 1
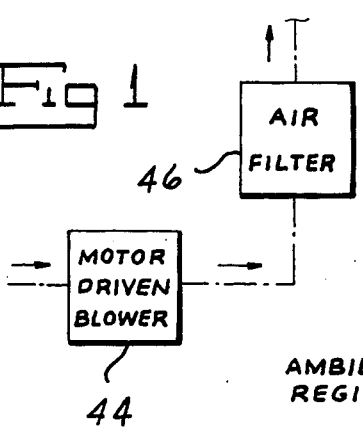
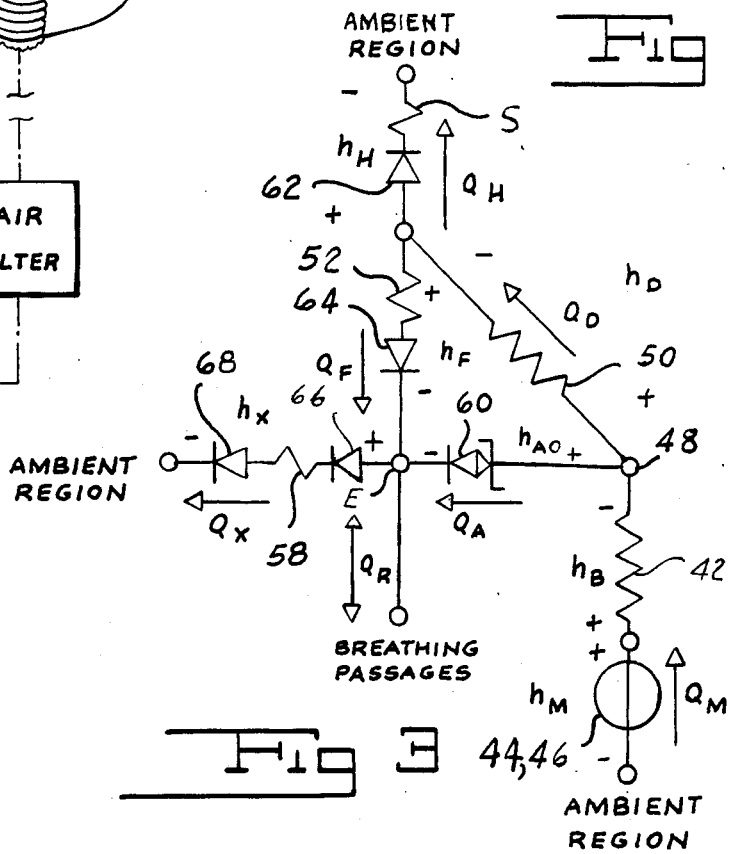
Fig 3

HELMET AIRFLOW SYSTEM

The Government has rights in this invention pursuant to Contract No. DAAK60-81-C-0146 awarded by the Department of the Army.

This is a continuation of co-pending application Ser. No. 530,483 filed on Sept. 9, 1983 and now abandoned.

FIELD OF THE INVENTION

Our invention relates to the field of breathing-air supply systems, and, more particularly, to an improved helmet airflow system.

BACKGROUND OF THE INVENTION

There are known in the prior art various forms of breathing sytems which provide filtered air to a wearer for breathing. Typically, air is drawn into an enclosed oral-nasal cavity through a filter by the action of inhalation, and air flow is controlled so as to prevent fogging of the lenses or goggles which often form part of the system. While these systems are generally satisfactory, it is desirable to have a system which is set up to prevent the infiltration of chemical or biological elements and to provide for cooling of the head of the wearer.

SUMMARY OF THE INVENTION

One object of our invention is to provide a helmet airflow system in which a positive pressure condition is maintained within the oronasal cavity over as much of the breathing range as possible.

Another object of our invention is to provide an airflow system which provides for lens defogging without causing discomfort to the eyes.

Still another object of our invention is to provide an airflow system which provides airflow for over-the-head cooling.

A further object of our invention is to provide an airflow system which provides a positive pressure inside the helmet to prevent infiltration of chemical or biological agents.

Other and further objects of our invention will appear from the following description.

In one aspect, our invention contemplates a mask adapted to enclose the eyes of a wearer and to enclose a breathing orifice of the wearer to form respective first and second cavities which are supplied with a breathable gas from a source through respective inlets coupling the source to the cavities. Preferably, the gas source includes a filter supplied with pressurized air from a blower.

In another aspect, our invention contemplates a mask which encloses the eyes of the wearer to form a first cavity supplied with a pressurized breathable gas and which encloses a breathing orifice of the wearer to form a second cavity receiving gas from the first cavity through a conduit. Preferably, the second cavity is also provided with a separate inlet such as described above, through which air is allowed to flow from the source in response to a predetermined pressure differential.

In yet another aspect, our invention contemplates a mask enclosing a portion of a wearer's face to form a cavity which is supplied with a breathable gas and which has a passage to the ambient region provided with a first check valve or other device for inhibiting the flow of gas from the ambient region to the passage and a second check valve or other device for inhibiting the flow of gas from the passage to the cavity.

In yet another aspect, our invention contemplates apparatus in which a helmet is adapted to fit over a wearer's head to form a space therebetween and in which means such as a face mask and shroud cooperate with the helmet to enclose the space thus formed. The space is supplied with a gas, preferably a breathable gas from the face mask, at superatmospheric pressure to provide over-the-head cooling as well as to prevent the seepage of unfiltered gases into the space.

BRIEF DESCRIPTION OF THE DRAWINGS

In the accompanying drawings, which form part of the instant specification and which are to be read in conjunction therewith, and in which like reference numerals are used to indicate like parts in the various views:

FIG. 1 is a perspective view of a person wearing an enclosed helmet together with our improved helmet airflow system.

FIG. 2 is a perspective view of the face mask portion of the system shown in FIG. 1, detached from the wearer.

FIG. 3 is a schematic diagram of the airflow channels of the system shown in FIGS. 1 and 2.

DESCRIPTION OF THE PREFERRED EMBODIMENT

Referring now to FIGS. 1 and 2, an individual indicated generally by the reference character 10 is shown wearing a helmet 12 adapted to fit over the individual's head to form a space S therebetween. Cooperating with helmet 12 to enclose the space S are a shroud 14, adapted to fit over the wearer's shoulders and to mate with the lower edge of the helmet 12, and a face piece 16 adapted to mate with the front and side edges of the helmet and which carries the shroud 14.

Face piece 16 comprises a protective outer shell 24 formed, for example, from a clear plastic. A portion 26 of shell 24 serves as a visor providing a transparent covering enclosing the eyes of the individual to form a first cavity D. In addition, the shell 24 supports an oronasal hardshell 28 which is attached to a face seal 36 to form an oronasal, or second, cavity E, generally isolated from the first cavity D enclosing the individual's nose and mouth. The hardshell 28 is formed with an inhalation port 30 and an exhalation port 32. The face seal 36 formed, for example, from rubber is carried inwardly of the periphery of the interior surfaces of the hardshell 28 and the visor 26. Face seal 36, together with a compressible closed-cell foam spacer 38 between seal 36 and shell 24, provides a seal between the wearer's face and the face piece 16. Seal 36 and spacer 38 are secured to each other and to the various parts of the face piece 16 by any suitable means. The face piece 16 is held in place against the wearer's face by straps 34 which extend from the opposite ends of the shell 24 and are secured to the helmet 12.

We fit outer shell 24 with a hose connector 40 which serves as an attachment for one end of an air hose 42, the opposite end of which is connected to a motor-driven blower 44 through a filter 46. Blower 44 supplies air from the surrounding atmosphere under pressure through the filter 46 and hose 42. A tee hose 48 which attaches to the hose connector 40 leads to the inhalation port 30 of the hardshell 28. A duct 50 communicating at its lower end with tee hose 48 opens into face vents 52 directing air past the eyes of the individual 10 and head vent 54 directing air over the head of the individual. As will be more fully described hereinbelow, face vents 52 provide air to the first cavity D formed by visor 26 for defogging the visor and cooling the face of the wearer. An opening 56 in the hardshell enclosure provides a conduit between the first cavity D and the oronasal cavity E to supply air to the latter cavity for breathing. Inhalation port 30 provides additional breathing air directy to the oronasal cavity E to prevent excessive airflow through the first cavity D across the eyes of the wearer. Head vent 54 provides air to the space S for over-the-head cooling and for maintaining a positive pressure inside the space S to prevent the infiltration of foreign substances such as chemical or biological agents. The air supplied to the oronasal cavity E for breathing is exhausted by the wearer into the surrounding atmosphere throuh an exhalation duct 58 leading from the exhalation port 32.

FIG. 3 is a schematic diagram of the airflow system. As shown in this figure, inhalation port 30 is provided with a check valve 60 for preventing the backflow of air from the cavity E. Valve 60 is spring-loaded to maintain a relatively constant pressure on the upstream side of the valve over a range of airflows. In a similar manner, head vent 54 is provided with a check valve 62 to prevent the backflow of air from the over-the-head space S, while opening 56 in the hardshell 28 is provided with a check valve 64 to prevent the backflow of air from cavity E. Exhalation duct 58 is provided with a first check valve 66 at its inlet and a second check valve 68 at its outlet to prevent the backflow of air from the ambient region to the cavity E. A pair of check valves are used in this manner so that the air trapped in the duct 58 between the two valves 66 and 68 acts as a buffer should one or both of the valves fail.

In FIG. 3, $Q_M$ represents the rate of airflow through blower 44, filter 46, and hose 42, $Q_A$ the flow rate through the inhalation check valve 60, $Q_D$ the flow rate through duct 50, $Q_H$ the flow rate through head vent check valve 62 and space S, $Q_F$ the flow rate through face vents 52 and check valve 64 into oronasal cavity E, $Q_X$ the flow rate out of the oronasal cavity E through the exhalation check valves 66 and 68 and duct 58, and $Q_R$ the wearer's respiratory airflow rate. Similarly, the quantities $h_M$, $h_D$ and the like represent the pressure drops across the various branches, with the sign conventions shown in FIG. 3. The quantity $h_{AO}$ represents the minimum pressure drop required to open spring-loaded check valve 60.

In operation of our helmet airflow system, blower 44 supplies breathable air under pressure through filter 46 and hose 42 to the hose connector 40 in face piece 16. The air then enters tee hose 48, where it is distributed according to respiratory demand. Thus, in the absence of breathing, the pressure available at tee hose 48 is greater than the opening pressure $h_{AO}$ of the check valve 60 and so permits a portion of the available air to flow directly to the oronasal cavity E. The remaining air travels through duct 50 to the face vents 52 and head vent check valve 62 where the airflow splits again. A portion of this air flows out face vents 52 and across the visor 26 and face of the wearer into the oronasal cavity E through check valve 64, while the remaining air from duct 50 flows out head vent check valve 62 to cool the wearer's head and pressurize the space S to prevent the infiltration of chemical or biological agents into that region. From oronasal cavity E air escapes into the ambient region through check valve 66, exit duct 58 and check valve 68, which remain open at this time. Owing to the resistance to airflow offered by exhalation duct 58 and by the check valves 66 and 68 at its inlet and outlet, the cavity E is pressurized so as to prevent the infiltration of chemical or biological agents.

In response to moderate inhalation, the pressure inside the oronasal cavity E drops to a sufficiently low level that exit check valves 66 and 68 close while valve 60 remains open to admit additional air via tee hose 48. A still greater rate of inhalation reduces the pressure at the downstream end of head vent vent 54 to the level of the ambient region, whereupon valve 62 closes to prevent the inflow of possibly noxious air from the over-the-head space S enclosed by helmet 12 and shroud 14.

In response to moderate exhalation, on the other hand, the pressure inside the oronasal cavity E rises to a sufficiently high level that valve 64 closes to prevent the backflow of air from the oronasal cavity E into the region behind the visor 26. Valves 66 and 68 remain open under exhaust air pressure to permit exhaust through exhalation duct 58. Head vent check valve 62 also remains open to allow for over-the-head airflow. A still greater rate of exhalation raises the pressure inside cavity E to such a level that spring-loaded check valve 60 closes to prevent the further flow of air into the cavity E from the hose 48.

It will be apparent to those skilled in the art that the quantitative values associated with the various parameters, such as the blower pressure, the path resistances, and the flow characteristics of the check valves as a function of pressure, may be selected so as to satisfy a particular set of airflow requirements.

It will be seen that we have accomplished the objects of our invention. We have provided a helmet airflow system in which a positive pressure condition is maintained within the oronasal cavity over as much of the breathing range as possible. Our airflow system provides for lens defogging without causing discomfort to the eyes and provides airflow for over-the-head cooling. In addition, our system provides a positive pressure inside the helmet-and-shroud ensemble to prevent infiltration of chemical or biological agents.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefor, to be understood that our invention is not to be limited to the specific details shown and described.

Having thus described our invention, what we claim is:

1. Apparatus including in combination a helmet having front and side edges defining a peripheral edge to extend above the eyes and along the sides of the wearer's head and adapted to fit over a wearer's head to define a space over the wearer's head immediately adjacent thereto said space having boundaries defined by the inside surface of said helmet and the wearer's head, a face piece adapted to mate with said front and side edges of said helmet and to enclose a portion of the face of the wearer to form a cavity therewith generally isolated from said space, means for securing said face piece to said helmet, means cooperating with said helmet and said face piece to restrict flow of gas from said space while permitting leakage flow therefrom, means forming an inlet in said face piece for receiving a gas, means forming a first passage in said face piece between said inlet and said cavity, and means forming a second passage in said face piece permitting the flow of said gas between said inlet and said space.

2. Apparatus as in claim 1 in which said second passage has an outlet adjacent to said space to direct said gas therethrough.

3. Apparatus as in claim 1 including means for preventing the flow of gas from said space through said second passage.

4. Apparatus as in claim 1 including means for providing a breathable gas to said inlet at superatmospheric pressure.

5. Apparatus as in claim 1 in which said restricting means comprises a shroud adapted to fit over an upper portion of the wearer's body.

6. Apparatus as in claim 1 in which said face piece is adapted to enclose the eyes of the wearer to form said cavity.

7. Apparatus as in claim 1 in which said face piece is adapted to enclose a breathing orifice of the wearer to form said cavity.

8. Apparatus including in combination a helmet having front and side edges defining a peripheral edge to extend above the eyes and along the sides of a wearer's head and adapted to fit over a wearer's head to define a space over the wearer's head immediately adjacent thereto said space having boundaries defined by the inside surface of said helmet and the wearer's head, a face piece adapted to enclose a portion of the face of the wearer to form a cavity therewith generally isolated from said space, means for securing said face piece to said helmet, means forming an inlet in said face piece for receiving a gas, means forming a first passage in said face piece between said inlet and said cavity, and means forming a second passage in said face piece permitting the flow of said gas between said inlet and said space, said second passage having an outlet adjacent to said space to direct said gas therethrough.

9. Apparatus as in claim 8 in which said helmet has front and side edges defining a facial opening therein, said face piece being adapted to mate with said front and side edges of said helmet.

10. Apparatus as in claim 8 including means cooperating with said helmet and said face piece to restrict the flow of gas from said space while permitting leakage flow therefrom.

11. Apparatus as in claim 8 in which said face piece is adapted to enclose the eyes of the wearer to form said cavity, said first passage having a lower end adjacent to said inlet and an upper end adjacent to said cavity, said second passage extending between said upper end of said first passage and said space.

* * * * *